US007522872B2

(12) United States Patent
Fukuta

(10) Patent No.: US 7,522,872 B2
(45) Date of Patent: Apr. 21, 2009

(54) SHEET CONVEYING DEVICE AND IMAGE FORMING APPARATUS

(75) Inventor: Kazushi Fukuta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 346 days.

(21) Appl. No.: 11/358,081

(22) Filed: Feb. 22, 2006

(65) Prior Publication Data

US 2006/0188306 A1 Aug. 24, 2006

(30) Foreign Application Priority Data

Feb. 22, 2005 (JP) ..... 2005-045733

(51) Int. Cl.
*G03G 15/00* (2006.01)

(52) U.S. Cl. ..... 399/390; 399/388

(58) Field of Classification Search ..... 399/390
See application file for complete search history.

(56) References Cited

U.S. PATENT DOCUMENTS

| | | | | |
|---|---|---|---|---|
| 5,740,498 | A | 4/1998 | Tsuchiya | |
| 5,758,252 | A * | 5/1998 | Enomoto et al. | 399/407 |
| 6,415,119 | B2 | 7/2002 | Nishimura et al. | |
| 6,928,252 | B2 | 8/2005 | Takami et al. | |
| 2003/0039495 | A1 * | 2/2003 | Takami et al. | 399/357 |
| 2003/0049043 | A1 * | 3/2003 | Fuwazaki et al. | 399/98 |
| 2003/0185588 | A1 | 10/2003 | Takami et al. | |

FOREIGN PATENT DOCUMENTS

| | | | | |
|---|---|---|---|---|
| JP | 4122972 | | 4/1992 | |
| JP | 406083165 | A * | 3/1994 | 399/176 |
| JP | H09-240870 | A | 9/1997 | |
| JP | 2001-075457 | A | 3/2001 | |
| JP | 2001-270631 | A | 10/2001 | |
| JP | 2004299810 | | 10/2001 | |
| JP | 2003295720 | | 10/2003 | |
| JP | 2004-299810 | A | 10/2004 | |
| JP | 2004352404 | A * | 12/2004 | |

OTHER PUBLICATIONS

Japan Patent Office, Office Action dated Sep. 11, 2007 in corresponding Application No. JP 2005-045733.

* cited by examiner

*Primary Examiner*—Daniel J Colilla
*Assistant Examiner*—Allister Primo
(74) *Attorney, Agent, or Firm*—Baker Botts, LLP

(57) ABSTRACT

A sheet conveying device includes: a conveyance unit that conveys a sheet along a sheet conveying path; a paper dust removal roller that is provided in the sheet conveying path to cover a range that is longer than a width of the sheet, the paper dust removal roller removing paper dust that is adhered to the sheet by rotating as the sheet is conveyed; a first dust removing member that contacts with a first portion of the paper dust removal roller where contacts with edges of the sheet, and removes paper dust that is adhered to a surface of the paper dust removal roller; and a second dust removing member that contacts with a second portion of the paper dust removal roller where contacts with a surface of the sheet, and remove paper dust that is adhered to the surface of the paper dust removal roller.

8 Claims, 8 Drawing Sheets

SHEET CONVEYING DEVICE AND IMAGE FORMING APPARATUS

CROSS REFERENCE TO RELATED APPLICATION

This application claims priority from Japanese Patent Application No. 2005-045733 filed on Feb. 22, 2005, the entire subject matter of which is incorporated herein by reference.

TECHNICAL FIELD

The present invention may relate to a sheet conveying device for conveying sheets one by one and an image forming apparatus having the sheet conveying device. More specifically, the invention may relate to a sheet conveying device incorporating a paper dust removal roller for removing paper dust that is adhered to a sheet and an image forming apparatus having such a sheet conveying device.

BACKGROUND

Sheet conveying devices for conveying a sheet in various kinds of apparatus such as an image forming apparatus are known in which a paper dust removal roller is provided in a sheet conveying path to remove paper dust that is adhered to a sheet. A sheet conveying device of this kind is known which employs an operation of removing paper dust off the paper dust removal roller with such a member as a sponge to maintain the efficiency of the paper dust removal to remove paper dust (e.g., see JP-A-2004-299810).

However, the paper dust occurring on a sheet is classified into paper dust produced by a sheet's rubbing against individual apparatus components and paper dust produced at the time of cutting the sheet into a desired size. The former paper dust is mainly fibers of cellulose or the like, and the latter paper dust is mainly powder of minerals such as calcium carbonate. The latter paper dust is produced more at ends (hereinafter also called "edges") of a sheet in the direction (hereinafter also called "width direction") perpendicular to a conveying direction of the sheet.

Therefore, where paper dust is wiped off a paper dust removal roller only by a sponge, paper dust of the latter kind is accumulated in wedge form between the sponge and the paper dust removal roller at positions corresponding to the edges of a sheet. Being powder of minerals, the thus-accumulated paper dust of the latter kind damages the surface of the paper dust removal roller as it rotates. As a result, conventionally, the durability of the paper dust removal roller cannot be increased sufficiently and hence the running cost of the sheet conveying device is increased.

SUMMARY

One aspect of the present invention may provide a sheet conveying device capable of satisfactorily preventing the surface of a paper dust removal roller from being damaged by paper dust that is powder of minerals, as well as an image forming apparatus using such a sheet conveying device.

A sheet conveying device may include: a conveyance unit that conveys a sheet along a sheet conveying path; a paper dust removal roller that is provided in the sheet conveying path to cover a range that is longer than a width of the sheet in a direction perpendicular to a conveyance direction, the paper dust removal roller removing paper dust that is adhered to the sheet by rotating as the sheet is conveyed; a first dust removing member that contacts with a first portion of the paper dust removal roller where contacts with edges of the sheet, and removes paper dust that is adhered to a surface of the paper dust removal roller; and a second dust removing member that contacts with a second portion of the paper dust removal roller where contacts with a surface of the sheet, and remove paper dust that is adhered to the surface of the paper dust removal roller.

An image forming apparatus may include: a sheet conveying device that conveys a sheet; and an image forming unit that forms an image on the sheet conveyed by the sheet conveying device. The sheet conveying device may include: a conveyance unit that conveys a sheet along a sheet conveying path; a paper dust removal roller that is provided in the sheet conveying path to cover a range that is longer than a width of the sheet in a direction perpendicular to a conveyance direction, the paper dust removal roller removing paper dust that is adhered to the sheet by rotating as the sheet is conveyed; a first dust removing member that contacts with a first portion of the paper dust removal roller where contacts with edges of the sheet, and removes paper dust that is adhered to a surface of the paper dust removal roller; and a second dust removing member that contacts with a second portion of the paper dust removal roller where contacts with a surface of the sheet, and remove paper dust that is adhered to the surface of the paper dust removal roller.

DETAILED DESCRIPTION

An illustrative aspect of the present invention will be described hereinbelow by reference to the drawings.

Figure 1:
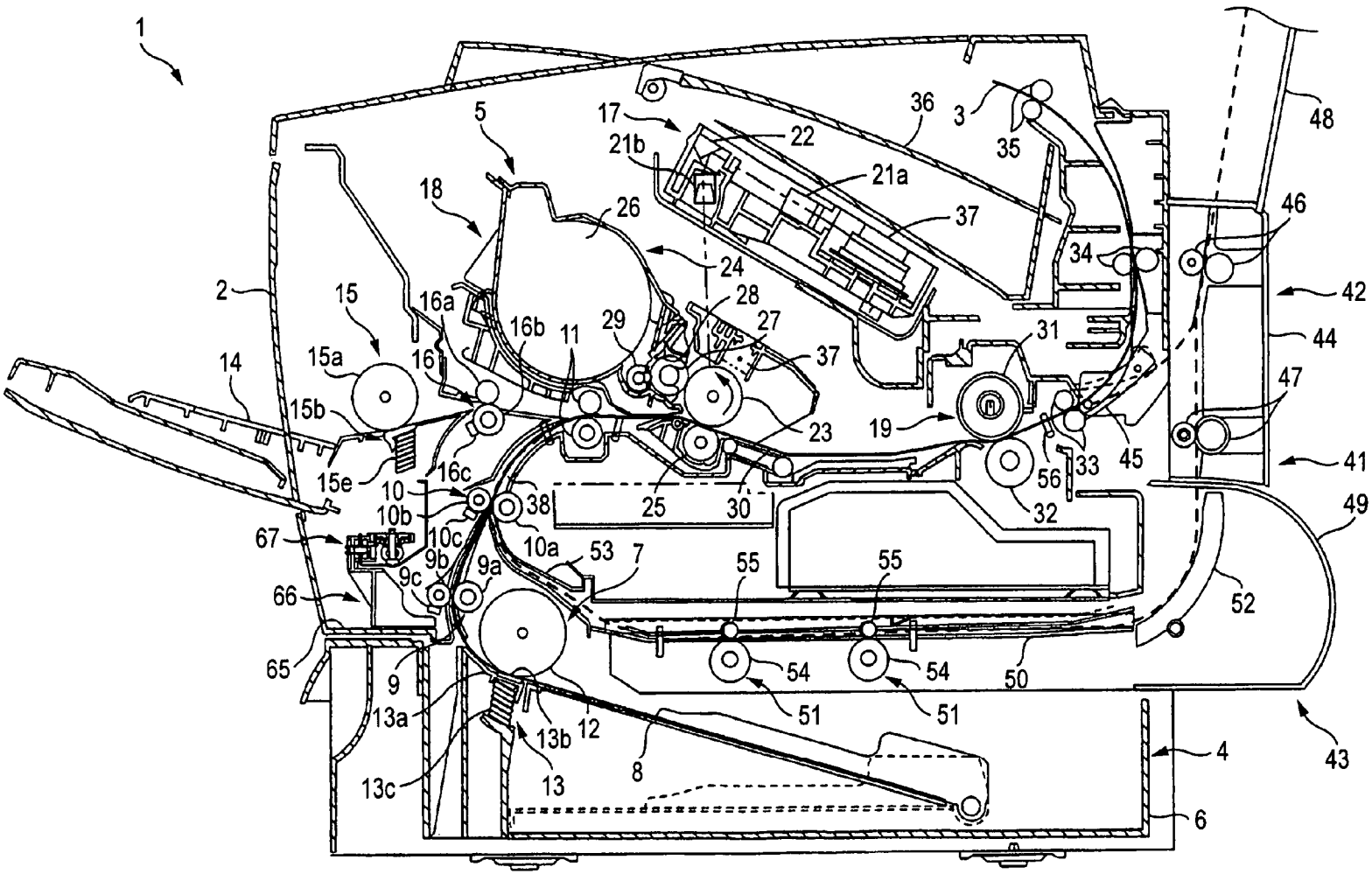
FIG. 1 is a side/sectional view of a substantial part showing the configuration of a laser printer according to an illustrative aspect.

FIG. 1 is a side/sectional view of a substantial part showing the configuration of a laser printer as an image forming apparatus to which the invention is applied. As shown in FIG. 1, the laser printer 1, which is configured as a laser printer that forms an image with an electrophotography, is equipped with, in a main body casing 2, a feeder unit 4 for supplying a sheet 3, an image forming section 5 as an image forming unit for forming a prescribed image on the sheet 3 supplied, and other units and components.

The feeder unit 4 is equipped with a sheet supply tray 6 which is detachably attached to a bottom portion of the main body casing 2, a sheet feed mechanism 7 which is disposed adjacent to one end of the sheet supply tray 6, a sheet pressing plate 8 which is provided inside the sheet supply tray 6, a first conveying unit 9 and a second conveying unit 10 as a sheet conveying device disposed downstream of the sheet feed mechanism 7 in the sheet conveying direction (in the following, the upstream side and the downstream side in the sheet conveying direction will also be referred to simply as "upstream side" and "downstream side," respectively), and registration rollers 11 which are disposed downstream of the first conveying unit 9 and the second conveying unit 10 in the sheet-conveying direction.

The sheet supply tray 6 assumes a box shape which has a top opening and can accommodate sheets 3, and it can be attached to and detached from the bottom portion of the main body casing 2 in the horizontal direction. The sheet feed mechanism 7 is provided with a sheet feed roller 12 and a separation pad 13 which is opposed to the sheet feed roller 12.

Figure 2:
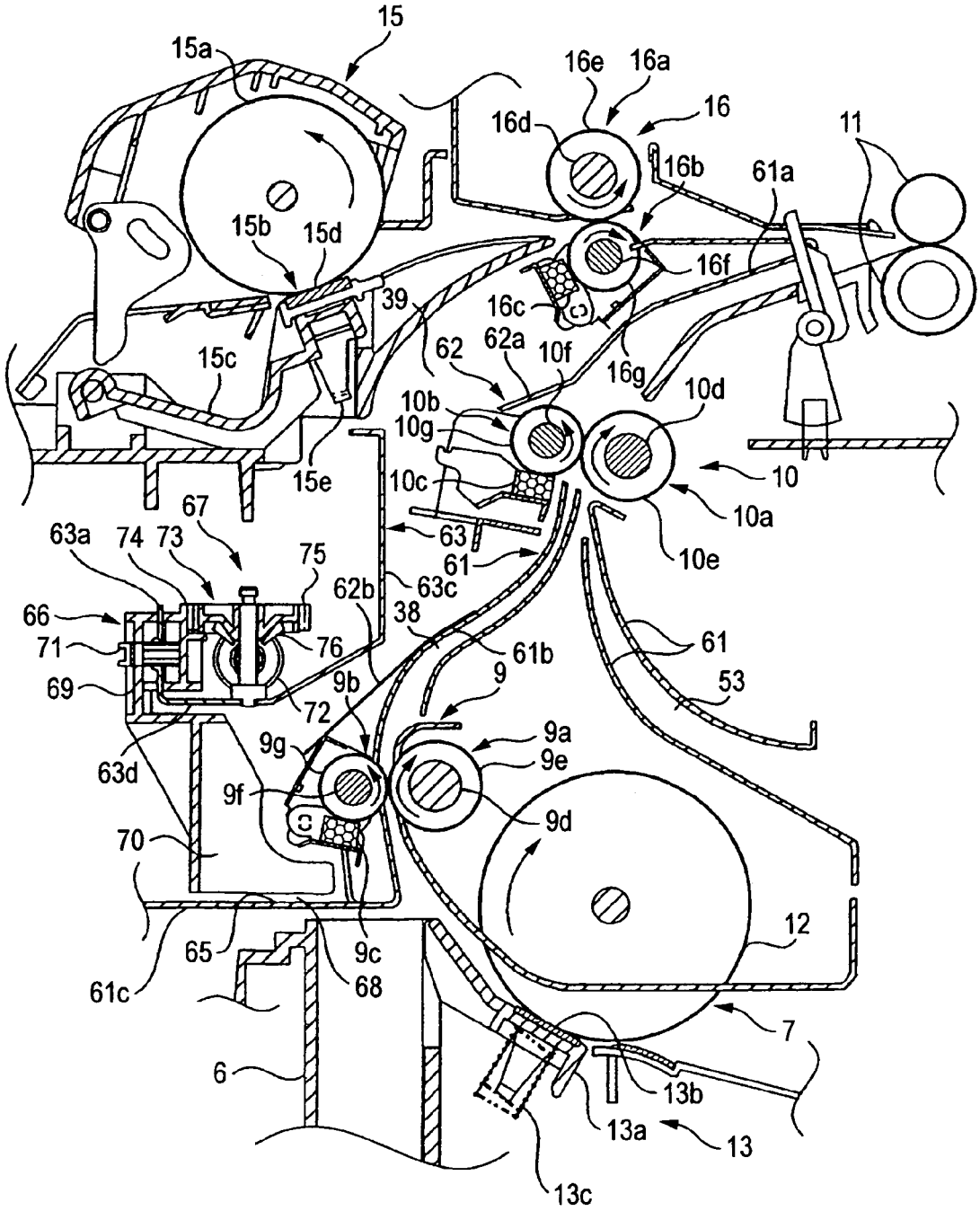
FIG. 2 is an enlarged side/sectional view of a substantial part showing a sheet transport passage of the laser printer.

As also shown in FIG. 2, the separation pad 13 is provided with a support frame 13*a*, a pad member 13*b*, and a spring 13*c*. The support frame 13*a* is supported under the sheet feed roller 12 in such a manner its bottom end portion is swingable, and it is urged by the spring 13*c* so that the pad member 13*b* is pressed against the sheet feed roller 12.

The pad member 13*b* is an elastic member made of urethane rubber or the like, and its length in the direction perpendicular to the sheet conveying direction (in the following, the length in the direction perpendicular to the sheet conveying direction will also be referred to as "width") is set shorter than the width of a sheet 3 (i.e., the width of a smallest sheet 3 on which printing can be performed by the laser printer 1). That is, to feed a sheet 3, the pad member 13*b* contacts only a central portion, in the width direction, of the sheet 3.

As shown in FIG. 1, the sheet pressing plate 8 is configured so that sheets 3 can be stacked thereon. Its end portion that is more distant from the sheet feed roller 12 is supported swingably, whereby its end portion that is closer to the sheet feed roller 12 can be moved in the vertical direction. And the sheet pressing plate 8 is urged upward by a spring (not shown) from its backside. Therefore, as the number of stacked sheets 3 increases, the sheet pressing plate 8 is swung downward against the urging force of the spring with its end portion more distant from the sheet feed mechanism 7 as a supporting point. A topmost sheet 3 on the sheet pressing plate 8 are pressed against the sheet feed roller 12 by the above-mentioned spring from the back side of the sheet pressing plate 8, held between the sheet feed roller 12 and the pad member 13*b* by rotation of the sheet feed roller 12, and then separated from each other and sent out one by one by their cooperation. A sheet 3 thus sent out is sent to the registration rollers 11 by the first conveying unit 9 and the second conveying unit 10 (described later) in a sheet transport passage 38 which is provided between the sheet feed mechanism 7 and the image forming section 5. The registration rollers 11, which are a pair of rollers, sends the sheet 3 to the image forming section 5 performing prescribed registration on the sheet 3.

The image forming section 5 is equipped with a scanner unit 17, the process unit 18, a fusing unit 19, etc. The scanner unit 17 occupies a top portion of the main body casing 2, and is equipped with a laser light emitting section (not shown), a polygon mirror 20 which is driven rotationally, lenses 21*a* and 21b, a reflector 22, etc. As indicated by a two-dot chain line in FIG. 1, a laser beam emitted from the laser light emitting section according to prescribed image data passes through or is reflected by the polygon mirror 20, the lens 21*a*, the reflector 22, and the lens 21b in this order, and is finally applied to the surface of a photoreceptor drum 23 of the process unit 18 (described below) to scan it at high speed.

The process unit 18 is disposed below the scanner unit 17 and is configured so as to be able to be attached to and detached from the main body casing 2. The process unit is equipped with the photoreceptor drum 23 as a photoreceptor, a development cartridge 24, a transfer roller 25 as a transfer unit, and a scorotron charger 37. The development cartridge 24, which is mounted in the process unit 15 detachably, is equipped with a toner container 26, a development roller 27 as a developing unit, a layer thickness limiting blade 28, a toner supply roller 29, etc.

A positively chargeable, non-magnetic one-component polymerization toner as a developer is charged in the toner container 26. Toner is supplied to the development roller 27 by the toner supply roller 29, and comes to be carried by the development roller 27 as a thin layer having a constant thickness through rubbing by the layer thickness limiting blade 28. On the other hand, the photoreceptor drum 23 is disposed rotatably so as to be opposed to the development roller 27. In the photoreceptor drum 23, a drum main body is grounded and its surface portion is a positively chargeable photoreceptor layer made of polycarbonate or the like.

As the photoreceptor drum 23 is rotated in a direction indicated by an arrow, the surface of the photoreceptor drum 20 is charged positively and uniformly by the scorotron charger 28 and then exposed to a laser beam coming from the scanner unit 17 (i.e., subjected to a high-speed scan), whereby an electrostatic latent image according to prescribed image data is formed. Then, toner that is carried by the development roller 27 and charged positively is supplied to the electrostatic latent image, that is, the exposed portions (where the potential has been lowered by the exposure to the laser beam) of the surface of the photoreceptor drum 23 (which was charged positively and uniformly), from the opposed portion of the development roller 28. And the toner comes to be carried selectively by the photoreceptor drum 20. As a result, the electrostatic latent image is visualized and inverted development is thereby attained.

The transfer roller 25 is disposed under the photoreceptor drum 20 so as to be opposed to it. In the development roller 25, a metal roller shaft is covered with a roller made of a conductive rubber material. A prescribed transfer bias with respect to the potential of the photoreceptor drum 23 is applied to the transfer roller 25. Therefore, a visible image that is carried by the photoreceptor drum 23 is transferred to a sheet 3 when the sheet 3 passes between the photoreceptor drum 23 and the transfer roller 25. The sheet 3 to which the visible image has been transferred is conveyed to the fixing unit 19 by a transport belt 30.

The fixing unit 19 is disposed downstream of the process unit 18 and is equippedwith aheating roller 31, apressing roller 32 which is pressed against the heating roller 31, and conveyance rollers 33 which are disposed downstream of the heating roller 31 and the pressing roller 32.

The heating roller 31 is made of a metal and equipped with a halogen lamp for heating. The heating roller 31 thermally fuses toner that has been transferred to a sheet 3 as the sheet 3 passes between the heating roller 31 and the pressing roller 32. Then, the conveyance rollers 33 transport the sheet 3 to conveyance rollers 34 and sheet ejection rollers 35 which are provided in the main body casing 2. The sheet 3 that has been conveyed to the conveyance rollers 34 is ejected onto a sheet ejection tray 36 by the sheet ejection rollers 35.

In the laser printer 1, residual toner that remains on the surface of the photoreceptor drum 23 after a visible image has been transferred to a sheet 3 by the transfer roller 25 is collected by the development roller 27 (what is called a cleanerless developing system). Collecting residual toner by the cleanerless developing system dispenses with a special member such as a blade for removing residual toner as well as a waste toner storage section, and thereby makes it possible to simplify the apparatus configuration.

The laser printer 1 is also provided with a re-conveying unit 41 which enables image formation on both surfaces of a sheet 3. The re-conveying unit 41 is configured in such a manner that a reversingmechanism 42 and a re-conveying tray 43 are integrated with each other. And the re-conveying unit 41 is mounted detachably in such a manner that the reversing mechanism 42 is attached externally to the rear end wall (right-hand end wall in FIG. 1) of the apparatus main body casing 2 and the re-conveying tray 43 is inserted in the apparatus main body casing 2 so as to be located above the feeder unit 4.

The reversing unit 42 is equipped with, in a casing 44 which has a generally rectangular cross section and is attached externally to the rear end wall of the main body casing 2, a flapper 45, reversing rollers 46, and re-conveying rollers 47. A reversing guide plate 48 projects upward from the top end of the casing 44.

The flapper 45 is disposed downstream of and in the vicinity of the conveyance roller 33 and supported rotatably at a rear position in the main body casing 2. The flapper 45 is provided swingably so as to be able to selectively switch, in accordance with energization/non-energization of a solenoid (not shown), the traveling direction of a sheet 3 that has been conveyed by the conveyance rollers 33 and bears an image on one surface between the direction toward the conveyance rollers 34 (indicated by a solid line) and the direction toward the reversing rollers 46 (indicated by an imaginary line; described later).

The reversing rollers 46, which are a pair of rollers, are disposed downstream of the flapper 45, that is, at a top position in the casing 44, and are configured in such a manner that their rotation direction can be switched between the normal direction and the reverse direction. The reversing rollers 46 are configured in such a manner as to first rotate in the normal direction to transport a sheet 3 toward the reversing guide plate 48 and then rotate in the reverse direction to transport the sheet 3 in the reverse direction.

The re-conveying rollers 47, which are a pair of rollers, are disposed downstream of and approximately right under the reversing rollers 46 in the casing 44. The re-conveying rollers 47 are configured so as to be able to transport, to the re-conveying tray 43, a sheet 3 that has been reversed by the reversing rollers 46.

The reversing guide plate 48 is a plate-like member extending upward from the top end of the casing 44, and is configured so as to guide a sheet 3 that is sent from the reversing rollers 46.

To form images on both surfaces of the sheet 3, in the reversing mechanism 42, first, the flapper 45 is switched to such a direction as to direct a sheet 3 to the reversing rollers 46. And a sheet 3 bearing an image on one surface is input to the reversing mechanism 42. Receiving the input sheet 3, the reversing rollers 46 rotate in the normal direction while holding the sheet 3 and thereby transport the sheet 3 so that the sheet 3 travels upward along the reversing guide plate 48 and projects outward temporarily. The reversing rollers 46 stop rotating in the normal direction when most of the sheet 3 has projected up outward and a tail portion of the sheet 3 has been held between the reversing rollers 46. Then, the reversing rollers 46 rotate in the reverse direction and thereby transport the sheet 3 in the reverse direction approximately right downward to the re-conveying rollers 47. A control is made so that the rotation direction of the reversing rollers 46 is switched from the normal direction to the reverse direction when a prescribed time has elapsed from an instant when a sheet passage sensor 56 which is disposed downstream of the fusing unit 19 detected the tail of the sheet 3. When the transport of the sheet 3 to the reversing rollers 46 has finished, the flapper 45 is switched to the original state, that is, the state for sending a sheet 3 coming from the conveyance rollers 33 to the conveyance rollers 34.

Then, the sheet 3 that has been conveyed in the reverse direction to the re-conveying rollers 47 is conveyed by the re-conveying rollers 47 to the re-conveying tray 43 (described below). The re-conveying tray 43 is equipped with a sheet supply section 49 to which a sheet 3 is supplied, a tray main body 50, and slant feed rollers 51.

The sheet supply section 49 is disposed under the reversing mechanism 42 and attached externally to the rear end wall of the main body casing 2, and it is equipped with a curved sheet guide member 52. In the sheet supply section 49, the sheet guide member 52 guides a sheet 3 that has been conveyed almost vertically by the re-conveying rollers 47 of the reversing mechanism 42 so as to orient the sheet 3 almost horizontally and to send out the sheet 3 toward the tray main body 50.

Substantially shaped like a rectangular plate, the tray main body 50 is disposed over the sheet supply tray 6 so as to extend almost horizontally. An upstream end portion of the tray main body 50 is connected to the sheet guide member 52, and its downstream end portion is connected to a re-conveying passage 53 which is connected to the sheet transport passage 38 at its halfway position to guide a sheet 3 from the tray main body 50 to the second conveying unit 10.

Two pairs of slant feed rollers 51 for conveying a sheet 3 while causing it to be kept in contact with a reference plate (not shown) are disposed at halfway positions, in the sheet conveying direction, in the tray main body 50 so as to be spaced from each other by a prescribed interval in the sheet conveying direction.

Each pair of slant feed rollers 51 consists of a slant feed drive roller 54 and a slant feed follower roller 55. The slant feed drive roller 54 is disposed in the vicinity of the reference plate (not shown; located at one end, in the width direction, of the tray main body 50) in such a manner that its axial line extends approximately perpendicularly to the sheet conveying direction. The slant feed follower roller 55 is opposed to the slant feed drive roller 54 via a sheet 3, and its axial line extends in a direction that is inclined from the direction approximately perpendicular to the sheet conveying direction so that a sheet 3 is fed toward the reference plate.

A sheet 3 that has been sent out from the sheet supply section 49 to the tray main body 50 goes through the re-conveying passage 53 while the one edge, in the width direction, of the sheet 3 is kept in contact with the reference plate by the slant feed rollers 51, and the sheet 3is flipped over again and conveyed to the image forming section 5. The back surface of the sheet 3 that has been conveyed to the image forming section 5 is opposed to and brought into contact with the photoreceptor drum 23, whereby a visible image is transferred to the sheet 3. Then, the sheet 3 is subjected to fusing in the fusing unit 19 and ejected onto the sheet ejection tray 36 in a state that images are formed on both surfaces.

As shown in FIG. 2, the laser printer 1 is configured so as to be able to remove, in a well-balanced manner, with the first conveying unit 9 and the second conveying unit 10 which are arranged in the sheet transport passage 38, paper dust 90 (see FIG. 4) that was produced at the edges of a sheet 3 at the time of cutting, paper dust that was adhered to the entire surface of the sheet 3 originally, and paper dust that has been produced on the surface of the sheet 3 by rubbing against each other of the pad member 13*b* and the sheet feed roller 12 of the sheet feed mechanism 7.

The first conveying unit 9 is disposed at an upstream position in the sheet transport passage 38; that is, it is disposed downstream of the sheet feed roller 12 of the sheet feed mechanism 7 in the sheet conveying direction (a prescribed interval exists between the first conveying unit 9 and the sheet feed roller 12) and upstream of the connecting position of the sheet transport passage 38 and the downstream end of the re-conveying passage 53. The first conveying unit 9 is equipped with a first conveyance roller 9*a* for conveying a sheet 3, a first paper dust removal roller 9*b* which is disposed on the other side of the sheet transport passage 38 from the first conveyance roller 9*a* and opposed to the first conveyance roller 9*a*, and a first sponge member 9*c* which is disposed under and opposed to the first paper dust removal roller 9*b*.

The first conveyance roller 9*a* projects into the sheet transport passage 38 from inside the curve of the passage 38. The first conveyance roller 9*a* is configured in such a manner that a metal roller shaft 9*d* is covered with a rubber roller 9*e*, and it is driven rotationally in a direction indicated by an arrow (clockwise in FIG. 1) when motive power is transmitted to it from a motor (not shown).

The first paper dust removal roller 9*b* projects into the sheet transport passage 38 from outside the curve of the passage 38. The first paper dust removal roller 9*b* is configured in such a manner that a grounded metal roller shaft 9*f* is covered with a roller 9*g* whose surface is charged easily such as a roller made of a fluororesin or a roller having a fluorine-coated surface. The first paper dust removal roller 9*b* exists in an approximately central region that overlaps with the separation pad 13 when viewed in the sheet conveying direction so as to contact the portion, that contacted the pad member 13*b*, of the image forming surface of a sheet 3 which will contact the photoreceptor drum 23; the width of the roller 9*g* is shorter than that of the sheet 3 and a little longer than that of the pad member 13*b*. The term "width of the sheet 3" as used herein means the width range of the commonly used A4 to letter-size sheets (210 to 215 mm; the same applies to the following description).

The first paper dust removal roller 9*b* follows the first conveyance roller 9*a* and is thereby driven rotationally in a direction indicated by an arrow, that is, in the same direction as the sheet conveying direction in the region where the first paper dust removal roller 9*b* projects into the sheet transport passage 38 (counterclockwise in FIG. 1). Driven in this manner, the first paper dust removal roller 9*b* removes paper dust from a sheet 3 while the first paper dust removal roller 9*b* and the first conveyance roller 9*a* hold and transport the sheet 3.

As shown in FIG. 2, the first sponge member 9*c*, which is made of amaterial, such as polyurethane foam, capable of charging the first paper dust removal roller 9*b* easily, is disposed under and brought in pressure contact with the first paper dust removal roller 9*b* so as to be able to wipe paper dust off the first paper dust removal roller 9*b* at a position that is under the first paper dust removal roller 9*b* and on the opposite side of the first paper dust removal roller 9*b* to the sheet transport passage 38. The first sponge member 9*c* not only wipes paper dust off the first paper dust removal roller 9*b* but also friction-charges the surface of the roller 9*g* of the first paper dust removal roller 9*b* through rubbing against the first paper dust removal roller 9*b*. The width of the first sponge member 9*c* is set a little longer than that of the roller 9*g* of the first paper dust removal roller 9*b*.

As shown in FIG. 2, the second conveying unit 10 is disposed downstream of the first conveying unit 9 and in the vicinity of (downstream of) the connecting position of the sheet transport passage 38 and the downstream end of the re-conveying passage 53. The second conveying unit 10 is equipped with a second conveyance roller 10*a* for conveying a sheet 3, a second paper dust removal roller 10*b* which is disposed on the other side of the sheet transport passage 38 from the second conveyance roller 10*a* and opposed to the second conveyance roller 10*a*, and a second sponge member 10*c* which is disposed under and opposed to the second paper dust removal roller 10*b*.

The second conveyance roller 10*a* projects into the sheet transport passage 38 from inside the curve of the passage 38. The second conveyance roller 10*a* is configured in such a manner that a grounded metal roller shaft 10*d* is covered with a rubber roller 10*e*, and it is driven rotationally in a direction indicated by an arrow (clockwise in FIG. 1) when motive power is transmitted to it from a motor (not shown).

The second paper dust removal roller 10*b* projects into the sheet transport passage 38 from outside the curve of the passage 38. The second paper dust removal roller 10*b* is configured in such a manner that a metal roller shaft 10*f* is covered with a roller 10*g* whose surface is charged easily such as a roller made of a fluororesin or a roller having a fluorine-coated surface (a PFA-coated roller or a PFA tube roller is desirable).

Figure 3:
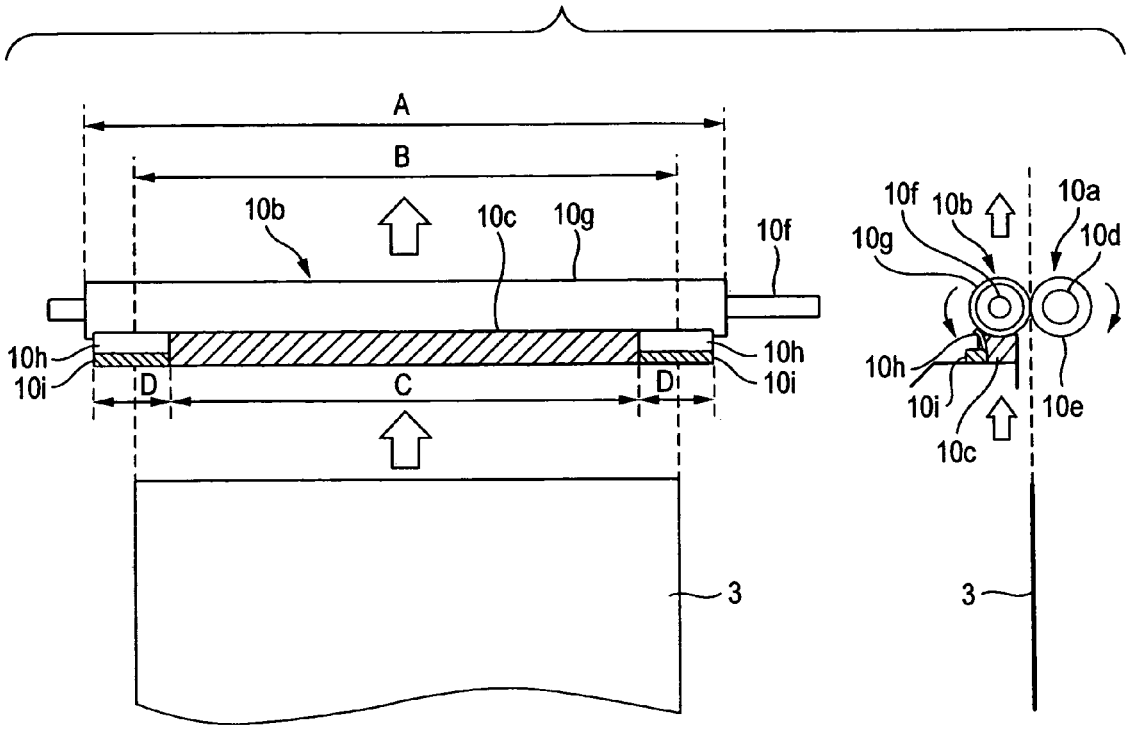
FIG. 3 is an explanatory diagram showing the structure of a second paper dust removal roller and its vicinity of the laser printer.

As shown in FIG. 3, the width A (e.g., 230 mm) of the roller 10*g* of the second paper dust removal roller 10*b* is set a little longer than the width B (e.g., in the above-mentioned range of 210 to 215 mm) of the sheet 3 so that the second paper dust removal roller 10*b* contacts the entire surface, that contacted the pad member 13*b*, of a sheet 3 supplied by the sheet feed roller 12 (i.e., the image forming surface of the sheet 3 which will contact the photoreceptor drum 23).

The second paper dust removal roller 10*b* is driven rotationally in a direction indicated by an arrow in FIG. 2, that is, in the same direction as the sheet conveying direction in the region where the secondpaper dust removal roller 10*b* projects into the sheet transport passage 38 (counterclockwise in FIG. 1) when motive power is transmitted to it from a motor (not shown) via a gear (not shown) . Driven in this manner, the second paper dust removal roller 10*b* removes paper dust from a sheet 3 while the second paper dust removal roller 10*b* and the second conveyance roller 10*a* hold and transport the sheet 3.

The second sponge member 10*c* is made of a material capable of charging the second paper dust removal roller 10*b* easily, more specifically, a foamed resin such as polyurethane foam or a porous elastic material such as non-woven fabric (ether-type polyurethane foam or nylon or rayon non-woven fabric is desirable). The second sponge member 10*c* is disposed under and brought in pressure contact with the second paper dust removal roller 10*b* so as to be able to wipe paper dust off the second paper dust removal roller 10*b* at a position that is under the second paper dust removal roller 10*b* and on the opposite side of the second paper dust removal roller 10*b* to the sheet transport passage 38. The second sponge member 10*c* not only wipes paper dust off the second paper dust removal roller 10*b* but also friction-charges the surfaceofthe roller 10*g* of the second paper dust removal roller 10*b* through rubbing against the second paper dust removal roller 10*b*.

As shown in FIG. 3, the width C (e.g., 200 mm) of the second sponge member 10*c* is set a little shorter than the width A of the second paper dust removal roller 10*b* and a pair of blades 10*h* made of resin film (urethane rubber or PET film is desirable) are disposed on both sides of the second sponge member 10*c*. A base portion of each blade 10*h* is fixed via a holder 10*i* and a tip portion of each blade 10*h* is in line contact with the surface of the roller 10*g* while countering the rotating roller 10*g*. The width D of the blades 10*h* is set at such a value (e.g., 13 mm) as to satisfy a relationship A>(2D+C)>B.

In the laser printer 1, sheets 3 stacked in the sheet supply tray 6 are sent out one by one by the cooperation between the sheet feed roller 12 and the separation pad 13. When each sheet 3 is sent out in this manner, a large amount of paper dust is produced on its image forming surface because of rubbing against the separation pad 13. However, in the first conveying unit 9, while the sheet 3 is held between and conveyed by the first conveyance roller 9*a* and the first paper dust removal roller 9*b*, its image forming surface is brought into contact with the roller 9*g* of the first paper dust removal roller 9*b*. Since the width of the first paper dust removal roller 9*b* is a little longer than that of the separation pad 13, paper dust that was produced on the sheet 3 in the region having approximately the same width as the width of the pad member 13*b* by rubbing against the separation pad 13 is removed by the first paper dust removal roller 9*b*. Then, the paper dust that is adhered to the roller 9*g* of the first paper dust removal roller 9*b* is wiped off by the first sponge member 9*c* when opposed to the first sponge member 9*c* as a result of the rotation of the first paper dust removal roller 9*b*.

Then, the sheet 3 is conveyed to the second conveying unit 10. While the sheet 3 is held between and conveyed by the second conveyance roller 10*a* and the second paper dust removal roller lob, its image forming surface is brought into contact with the roller 10*g* of the second paper dust removal roller 10*b*. Since the width of the second paper dust removal roller 10*b* is set a little longer than that of the sheet 3, paper dust 90 that was produced at the edges of a sheet 3 at the time of cutting, paper dust that was adhered to the entire surface of the sheet 3 originally, and residual paper dust that was not removed by the first paper dust removal roller 9*b* are removed by the roller 10*g* of the second paper dust removal roller 10*b*. Then, the paper dust that is adhered to the roller 10*g* of the second paper dust removal roller 10*b* is wiped off by the second sponge member 10*c* or raked off by the blades 10*h* when opposed to the second sponge member 10*c* and the blades 10*h* as a result of the rotation of the second paper dust removal roller 10*b*.

The advantages of removing paper dust off the roller 10*g* with both of the second sponge member 10*c* and the blades 10*h* instead of wiping off such paper dust with a single sponge member will be described below.

Figure 7:
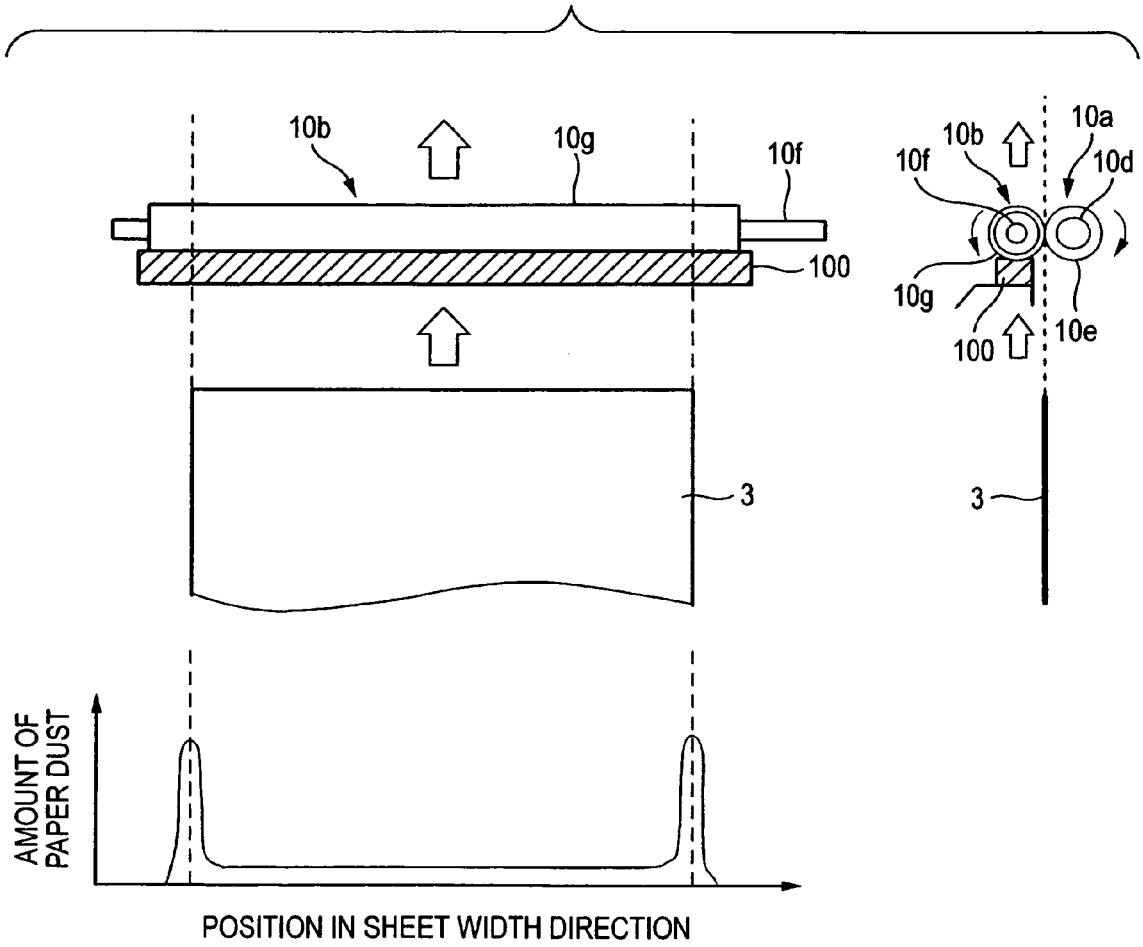
FIG. 7 is an explanatory diagram showing the structure of a comparative example corresponding to the second paper dust removal roller and its vicinity.

As shown in FIG. 7, at the time of cutting of a sheet 3, a large amount of paper dust 90 is produced particularly at the edges of the sheet 3. Whereas paper dust produced by rubbing against the pad member 13*b* is mainly fiber-like substances such as cellulose, the paper dust 90 is mainly powder of minerals such as calcium carbonate.

In general, the sheet 3 is made of pulp fiber (cellulose) and additives that are added internally or externally and the additives are a sizing agent, a size fixing agent, a paper surface quality improving agent, a strength enhancing agent, a wet strength agent, a pH control agent, a filler, etc. In general, the filler, which is used for making the composition of the sheet 3 denser and increasing its whiteness, opacity, smoothness, glossiness, etc., is a powder of minerals such as calcium carbonate (limestone), talc, and clay (China clay). Powder of those minerals is produced at the edges of a sheet 3 at the time of cutting and adhered to the edges and their vicinities as paper dust 90.

Figure 8:
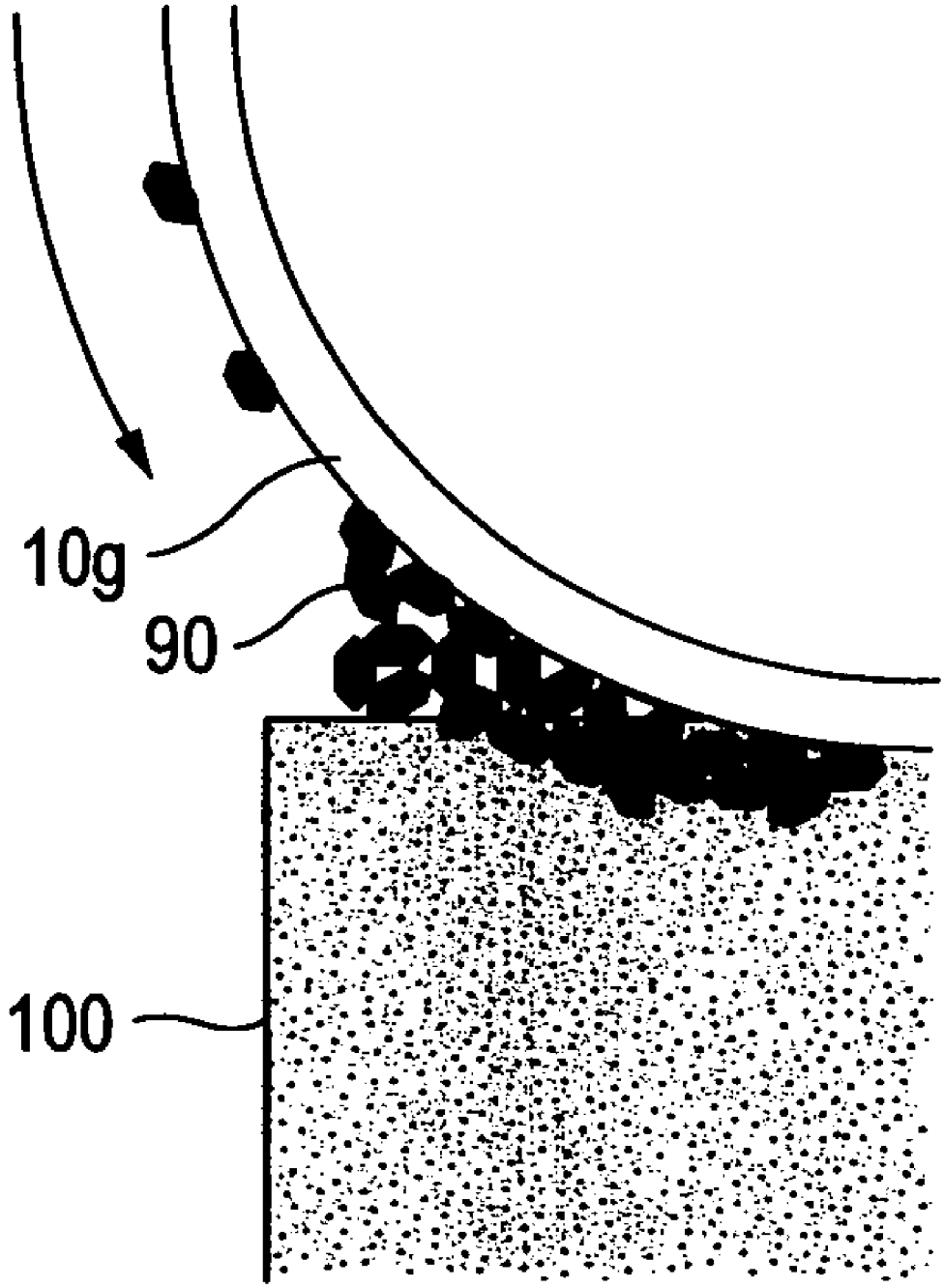
FIG. 8 is an explanatory diagram showing a problem of the comparative example.

Therefore, where paper dust that is adhered to the roller 10*g* is wiped off by a single sponge member 100 as shown in FIG. 7, paper dust 90 as mentioned above may be accumulated in wedge form between the sponge member 100 and the roller 10*g* at the positions corresponding to the edges and their vicinities of the sheet 3 as shown in FIG. 8. Being powder of minerals, the paper dust 90 thus accumulated may damage the surface of the roller 10*g* as the roller 10*g* rotates.

Figure 4:
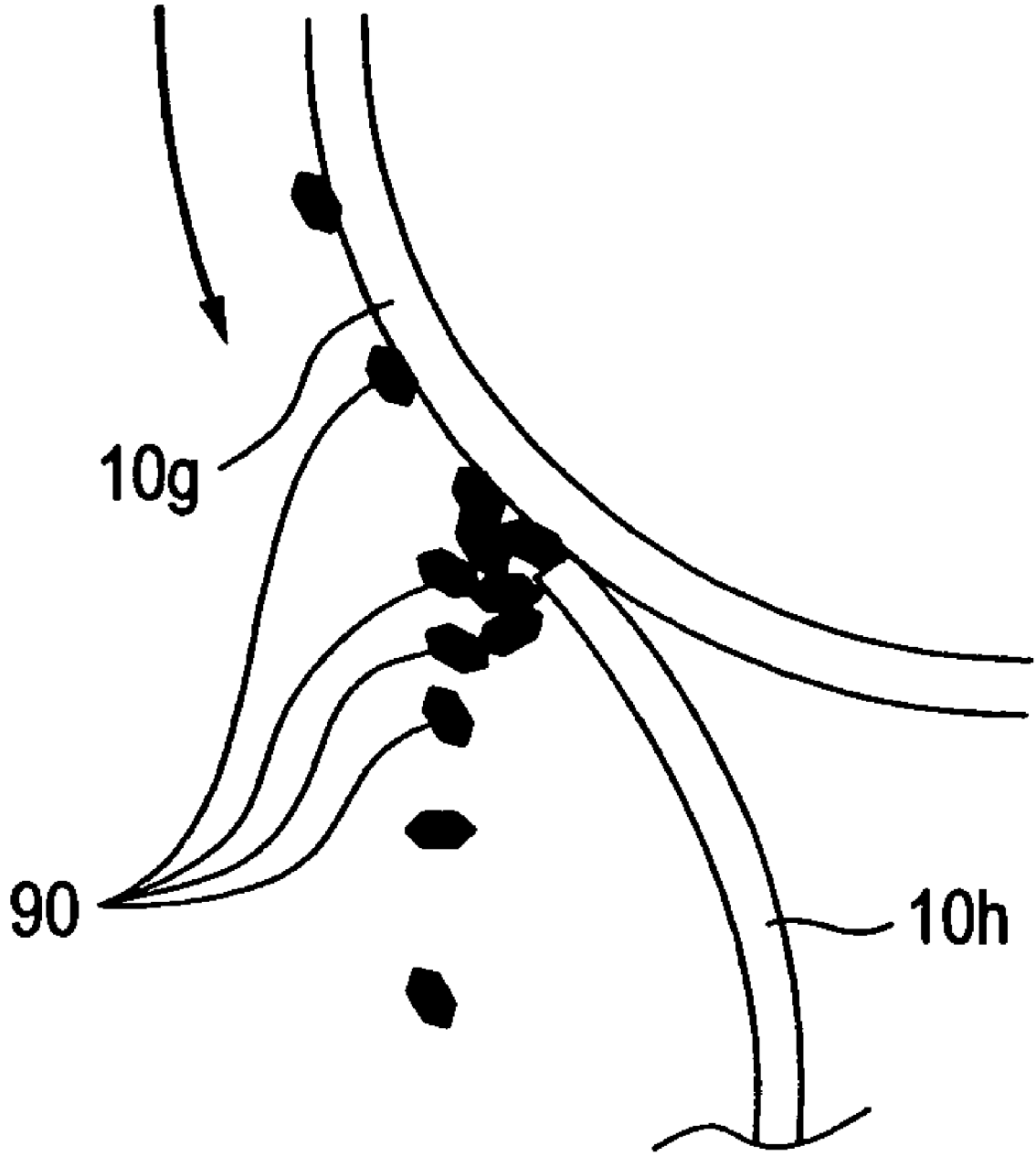
FIG. 4 is an explanatory diagram showing an advantage obtained by the structure of the second paper dust removal roller and its vicinity.

Returning to FIG. 3, in this illustrative aspect, the widths A, B, C, and D of the respective members are set in the above-described manner, whereby the blades 10*h* are opposed to the edges of a sheet 3 and rake off paper dust 90 that was produced at the edges of the sheet 3. Therefore, in this illustrative aspect, as shown in FIG. 4, mineral paper dust 90 can be isolated reliably from the surface of the roller 10*g* by raking it off, which satisfactorily prevents an event that the surface of the roller 10*g* is damaged by the paper dust 90. As a result, this illustrative aspect can increase the durability of the second paper dust removal roller 10*b* and reduce the running cost of the laser printer 1 satisfactorily.

In this illustrative aspect, in contrast to the case of the comparative example of FIG. 8, only fiber-like. paper dust occurs in that portion of the roller 10*g* which is to be opposed to the second sponge member 10*c* and hence the surface of the roller 10*g* is not damaged. If configured to rake off all the paper dust that is adhered to the roller 10*g* by a blade-shaped member, the rotating second paper dust removal roller 10*b* would receive a strong resistance and hence the manufacturing cost of the driving system of the apparatus would increase. In view of this, in this illustrative aspect, the second sponge member 10*c* which causes only a weak mechanical resistance wipes paper dust off that portion of the roller 10*g* which corresponds to a central portion of a sheet 3 where only fiber-like paper dust was produced. Therefore, the resistance to the second paper dust removal roller 10*b* can be reduced and hence the manufacturing cost of the laser printer 1 can be kept low satisfactorily.

In the above illustrative aspect, the first conveyance roller 9*a* and the second conveyance roller 10*a* correspond to a conveyance unit, the second paper dust removal roller 10*b* corresponds to a paper dust removal roller, the blades 10*h* correspond to raking members and first paper dust removing members, and the second sponge member 10*c* corresponds to a wiping member and a second paper dust removing member. The invention is not limited to the above illustrative aspect and can be practiced in various forms without departing from the spirit and scope of the invention.

Figure 5:
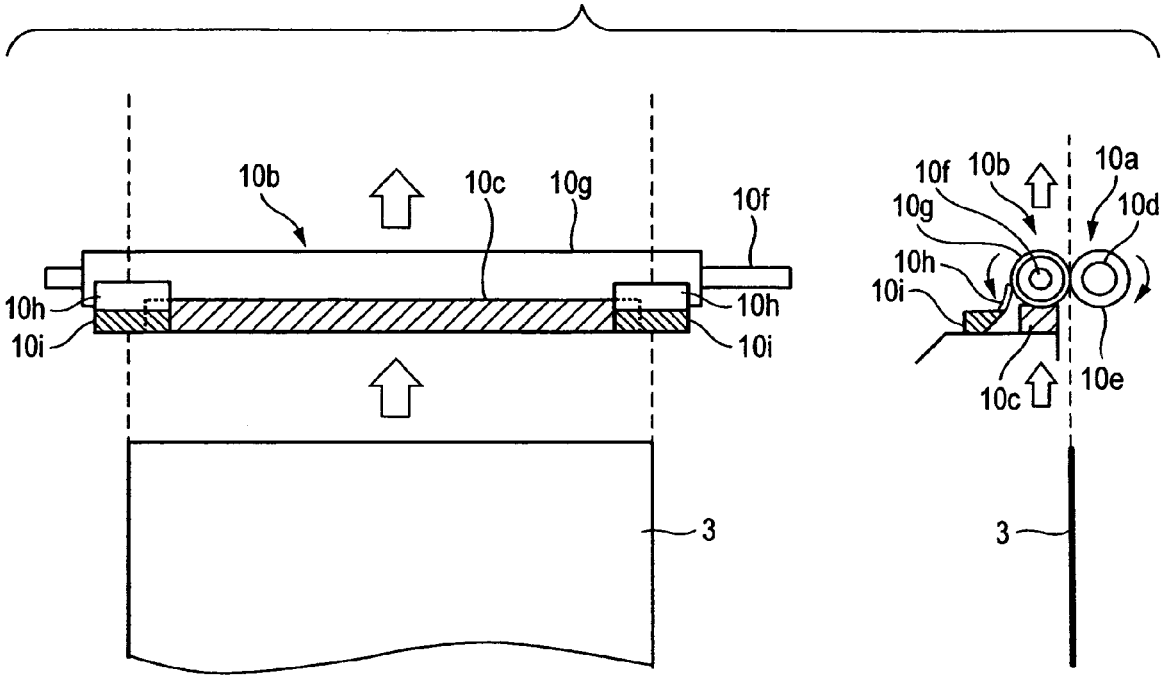
FIG. 5 is an explanatory diagram showing the structure of a modification of the second paper dust removal roller and its vicinity.

For example, as shown in FIG. 5, the blades 10*h* may overlap with the second sponge member 10*c* by forming a space between them. In this case, all paper dust can be removed from the surface of the roller 10*g* more reliably.

Figure 6:
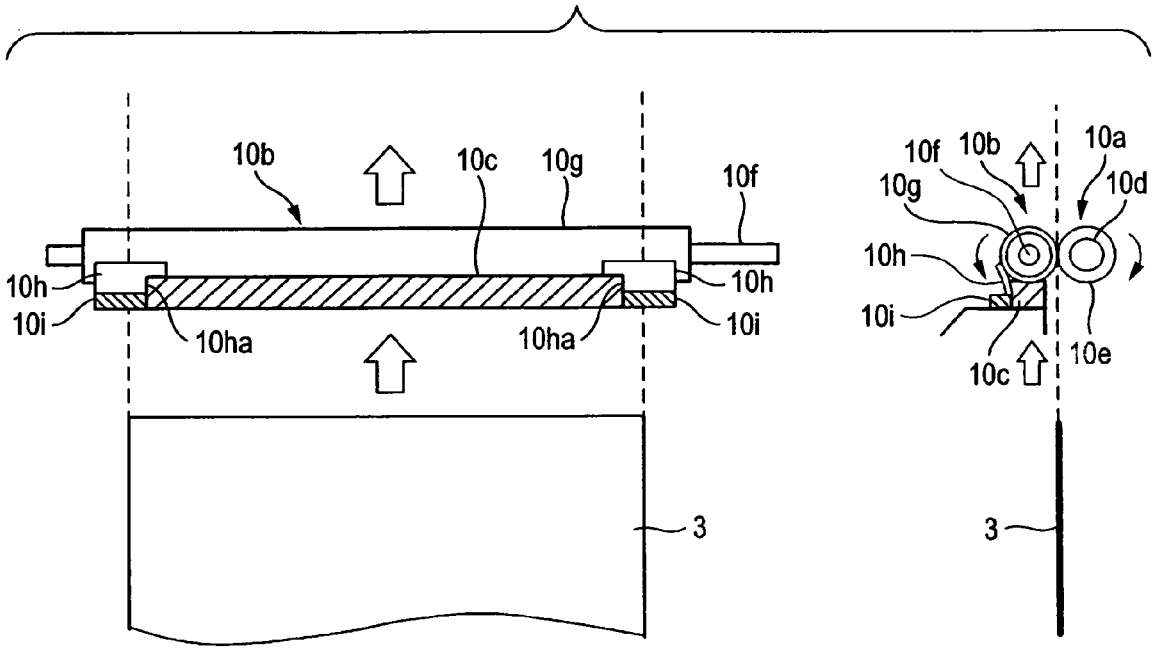
FIG. 6 is an explanatory diagram showing the structure of another modification of the second paper dust removal roller and its vicinity.

As shown in FIG. 6, the blades 10*h* may be formed with cuts 10*ha* in regions where the blades 10*h* and the second sponge member 10*c* overlap with each other. In this case, the blades 10*h* and the second sponge member 10*c* can overlap with each other with the holders 10i kept adjacent to the second sponge member 10*c*. In this case, as in the case of the modification of FIG. 5, all paper dust can be removed from the surface of the roller 10*g*.

Although in the above illustrative aspect the blades 10*h* are provided so as to conform to the size of the commonly used sheet 3, pairs of blades 10*h* may be provided so as to conform to the sizes of various kinds of sheets 3 used in the laser printer 1, respectively. In this case, mineral paper dust 90 produced at the edges of a sheet 3 having any of the various sizes can satisfactorily be raked off the second paper dust removal roller 10*b*. Further, another blade 10*h* may be provided at a position corresponding to the separation pad 13. In the case of what is called a side registration type in which the path of one edge of a sheet 3 is fixed irrespective of the sheet size, a large blade 10*h* may be provided on the side where the path of edge of a sheet 3 varies depending on the sheet size. Also in this case, mineral paper dust 90 produced at the edges of a sheet 3 having any of the various sizes can satisfactorily be raked off the second paper dust removal roller 10*b*. Still further, the apparatus may be configured in such a manner that a sheet 3 having a half size is supplied with its longer sides set parallel with the width direction. In addition, the sheet conveying device according to the invention can also be used in apparatus other than image forming apparatus, such as scanners.

The foregoing description of the illustrative aspect has been presented for purposes of illustration and description. It is not intended to be exhaustive or to limit the invention to the precise form disclosed, and modifications and variations are possible in light of the above teachings or may be acquired from practice of the invention. The illustrative aspect was chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. A sheet conveying device comprising:

a conveyance unit that conveys a sheet along a sheet conveying path;

a paper dust removal roller that is provided in the sheet conveying path to cover a range that is greater than a width of the sheet in a direction perpendicular to a conveyance direction, the paper dust removal roller removing paper dust that is adhered to the sheet by rotating as the sheet is conveyed;

a first dust removing member that contacts with a first portion of the paper dust removal roller where the paper dust removal roller contacts with edges of the sheet, and removes paper dust that is adhered to a surface of the paper dust removal roller; and a second dust removing member that contacts with a second portion of the paper dust removal roller where the paper dust removal roller contacts with a surface of the sheet, and removes paper dust that is adhered to the surface of the paper dust removal roller, wherein a width of the first dust removing member is less than a width of the second dust removing member.

2. The sheet conveying device according to claim 1, wherein the first dust removing member rakes off the paper dust that is adhered to the surface of the paper dust removal roller, and wherein the second dust removing member wipes off the paper dust that is adhered to the surface of the paper dust removal roller.

3. The sheet conveying device according to claim 1, wherein the first dust removing member contacts with the first portion of the paper dust removal roller to be in line contact, and wherein the second dust removing member contacts with the second portion of the paper dust removal roller to be in surface contact.

4. The sheet conveying device according to claim 1, wherein the first dust removing member and the second dust removing member overlap with each other to cover the entire width of the sheet in the direction perpendicular to the conveyance direction without forming any gaps.

5. The sheet conveying device according to claim 1, wherein the first dust removing member is configured as a plate-like member or as a film-like member, and wherein the second dust removing member is made of a porous elastic material.

6. The sheet conveying device according to claim 1, wherein the first dust removing member and the second dust removing member are respectfully made of materials different from each other.

7. An image forming apparatus comprising:

a sheet conveying device that conveys a sheet; and an image forming unit that forms an image on the sheet conveyed by the sheet conveying device, wherein the sheet conveying device comprises:

a conveyance unit that conveys a sheet along a sheet conveying path;

a paper dust removal roller that is provided in the sheet conveying path to cover a range that is greater than a width of the sheet in a direction perpendicular to a conveyance direction, the paper dust removal roller removing paper dust that is adhered to the sheet by rotating as the sheet is conveyed;

a first dust removing member that contacts with a first portion of the paper dust removal roller where the paper dust removal roller contacts with edges of the sheet, and removes paper dust that is adhered to a surface of the paper dust removal roller; and a second dust removing member that contacts with a second portion of the paper dust removal roller where the paper dust removal roller contacts with a surface of the sheet, and removes paper dust that is adhered to the surface of the paper dust removal roller, wherein a width of the first dust removing member is less than a width of the second dust removing member.

8. The image forming apparatus according to claim 7, wherein the image forming unit comprises:

a photoreceptor that is formed with an electrostatic latent image on a surface thereof when exposed to light;

an exposing unit that exposes the photoreceptor to form the electrostatic latent image on the surface of the photoreceptor;

a developing unit that develops the electrostatic latent image formed on the surface of the photoreceptor by adhering a developer to the electrostatic latent image; and a transfer unit that transfers the developer adhered to the photoreceptor to the sheet.

* * * * *